US009194395B2

(12) United States Patent
Ginies et al.

(10) Patent No.: US 9,194,395 B2
(45) Date of Patent: Nov. 24, 2015

(54) SCROLL REFRIGERATION COMPRESSOR WITH A DELIVERY VALVE AND A BYPASS VALVE

(75) Inventors: Pierre Ginies, Sathonay Village (FR); Christophe Ancel, Villefranche sur Saone (FR)

(73) Assignee: DANFOSS COMMERCIAL COMPRESSORS, Reyrieux (FR)

( * ) Notice: Subject to any disclaimer, the term of this patent is extended or adjusted under 35 U.S.C. 154(b) by 250 days.

(21) Appl. No.: 13/700,937

(22) PCT Filed: May 16, 2011

(86) PCT No.: PCT/FR2011/051087

§ 371 (c)(1),
(2), (4) Date: Nov. 29, 2012

(87) PCT Pub. No.: WO2011/151554

PCT Pub. Date: Dec. 8, 2011

(65) Prior Publication Data

US 2013/0089448 A1 Apr. 11, 2013

(30) Foreign Application Priority Data

Jun. 2, 2010 (FR) ..... 10 54288

(51) Int. Cl.
*F04C 18/02* (2006.01)
*F04C 29/12* (2006.01)
(Continued)

(52) U.S. Cl.
CPC ..... *F04C 29/128* (2013.01); *F04C 18/0215* (2013.01); *F04C 28/26* (2013.01); *F04C 29/126* (2013.01); *F04C 18/0246* (2013.01); *F04C 23/008* (2013.01)

(58) Field of Classification Search
CPC ..... F04C 18/0215
See application file for complete search history.

(56) References Cited

U.S. PATENT DOCUMENTS 5,674,058 A * 10/1997 Matsuda et al. ..... 418/55.1
5,855,475 A 1/1999 Fujio et al.
(Continued)

FOREIGN PATENT DOCUMENTS

CN 1196776 A 10/1998
DE 3632318 A1 3/1988
(Continued)

OTHER PUBLICATIONS

Jan. 19, 2011 French Preliminary Search Report issued in Application No. 1054288.
(Continued)

*Primary Examiner* — Mary A Davis
(74) *Attorney, Agent, or Firm* — Oliff PLC

(57) ABSTRACT

A compressor including: a stationary volute and a moving volute each including a plate provided with a scroll, said scrolls defining variable-volume compression chambers; a delivery line provided in the plate of the stationary volute; a delivery port arranged such as to establish a communication between the delivery line and a delivery chamber; and a non-return device including (i) a valve seat surrounding the delivery port and (ii) a delivery valve which can move between delivery port opening and closing positions. The compressor includes: at least one bypass passage having a first end opening into the delivery line at a point between the central compression chamber and the valve seat and a second end opening into an intermediate compression chamber or into a low-pressure portion of the compressor, and at least one bypass valve which can move between bypass passage closing and opening positions.

11 Claims, 8 Drawing Sheets

(51) Int. Cl.
*F04C 28/26* (2006.01)
*F04C 23/00* (2006.01)

(56) References Cited

U.S. PATENT DOCUMENTS

| | | | | |
|---|---|---|---|---|
| 6,095,764 | A | 8/2000 | Shibamoto et al. | |
| 6,164,940 | A * | 12/2000 | Terauchi et al. | 418/55.1 |
| 6,190,138 | B1 * | 2/2001 | Hugenroth et al. | 417/310 |
| 6,419,457 | B1 | 7/2002 | Seibel et al. | |
| 2003/0190247 | A1 | 10/2003 | Tsubono et al. | |
| 2005/0135939 | A1 | 6/2005 | Kim | |
| 2006/0099098 | A1 | 5/2006 | Lee et al. | |
| 2010/0028183 | A1 | 2/2010 | Sun | |

FOREIGN PATENT DOCUMENTS

| | | | |
|---|---|---|---|
| EP | 1 039 136 | A2 | 9/2000 |
| EP | 1519047 | A1 | 3/2005 |
| JP | S60-228788 | A | 11/1985 |
| JP | S62-29784 | A | 2/1987 |
| WO | WO 99/45274 | A1 | 9/1999 |

OTHER PUBLICATIONS

Sep. 21, 2012 International Search Report issued in PCT/FR2011/051084.
Korean Patent Publication 2006074489 to Kim et al., Machine Translation by K-PIO, Jul. 3, 2006.
Apr. 24, 2015 Final Rejection issued in U.S. Appl. No. 13/701,407.

* cited by examiner

SCROLL REFRIGERATION COMPRESSOR WITH A DELIVERY VALVE AND A BYPASS VALVE

The present invention relates to a scroll refrigeration compressor.

In a known way, a scroll refrigeration compressor comprises a first stationary volute and a second volute describing an orbital movement, each volute including a plate from which extends a scroll, both scrolls being engaged into each other and delimiting compression chambers of variable volume, the compression chambers having a volume which gradually decreases from the outside, where admission of the refrigerant occurs, towards the inside.

Thus, during the orbital movement of the first volute, the refrigerant fluid is compressed because of the reduction in the volume of the compression chambers and conveyed as far as the center of the first and second volutes. The compressed refrigerant flows out in the central portion towards a delivery chamber via a delivery line made in the central portion of the first volute.

In order to improve the performances of such a compressor depending on the seasons, and more particularly depending on the cold demand, it is known how to make compressors with a variable capacity and/or with a variable compression rate.

Document U.S. Pat. No. 5,855,475 describes a scroll refrigeration compressor with a variable compression rate comprising orifices for letting through a fluid refrigerant, made in the plate of the stationary volute and each opening into one of the compression chambers and into the delivery chamber, respectively, on the one hand, and bypass valves positioned on the surface of the plate of the stationary volute turned towards the side opposite to the scrolls and each moveable between an open position allowing delivery of fluid refrigerant from the corresponding compression chamber to the delivery chamber and a closing position preventing the delivery of fluid refrigerant from the corresponding compression chamber to the delivery chamber on the other hand.

When one of the bypass valves is subject, on its face turned towards the plate of the stationary volute, to a pressure below the pressure in the delivery chamber, said valve is maintained in its closed position and isolates the corresponding compression chamber from the delivery chamber. The result of this is that the compression rate of the compressor is maintained at its maximum value.

When one of the bypass valves is subject on its face turned towards the plate of the stationary volute, to a pressure above the pressure in the delivery chamber, said valve is elastically deformed towards its opening position and puts the corresponding compression chamber in communication with the delivery chamber. The result of this is thus delivery towards the delivery chamber of a portion of the compressed fluid refrigerant in the compression chambers into which open the passage orifices before this portion of fluid refrigerant reaches as far as the center of the scrolls.

The presence of such passage orifices and of such bypass valves gives the possibility of reducing depending on the seasons, the compression rate of each compression chamber and consequently avoiding overcompression of the fluid refrigerant. These provisions thus allow an improvement in the energy efficiency of the compressor.

The presence of such passage orifices and of such bypass valves also allows a reduction in the mechanical forces exerted on the volute and on the driving shaft of the moving volute, and therefore an increase in the reliability of the compressor.

However, the installation of such bypass valves on the upper surface of the stationary volute of a compressor may prove to be difficult, or even impossible, notably when access to the upper portion of the stationary volute is hindered by the existence of a high pressure/low pressure separation bell covering the stationary volute or by the presence of sealing elements at the delivery line.

Further, seal faults of such bypass valves may induce, upon stopping the compressor, leaks of refrigerant fluid and therefore migration of a portion of the refrigerant fluid located in the high pressure portion of the compressor towards the low pressure portion of the compressor. These leaks may cause <<washing>> of the guiding bearings of the shaft driving the moving volute, which may lead to a lack of lubrication of the latter upon restarting the compressor, and therefore to degradation of the performances of the latter.

Further, when the electric motor intended to drive into rotation the driving shaft of such a compressor is a three-phase motor, a connection fault of the power supply wires of such a motor causes an inversion of the direction of rotation of the latter, and therefore an inversion of the direction of rotation of the shaft driving the moving volute. This inversion of the direction of rotation of the driving shaft generates, because of the structure of the scrolls of the stationary and moving volutes, a depression in the center of these scrolls causing the stationary and moving volutes to be brought closer, and therefore an increase in the friction forces between the latter. Such friction forces cause overheating and wear of the two volutes and prohibitive heating-up of the motor which may cause degradation of the compressor if the connection fault is not detected sufficiently early.

The present invention aims at finding a remedy to all or part of these drawbacks, and advantageously, it consists of providing a scroll refrigeration compressor which is of a simple, economical and compact structure and which allows improvement in the performances of the compressor, while allowing simple and easy mounting of a valve arrangement on the stationary volute of the compressor.

For this purpose, the present invention relates to a scroll refrigeration compressor comprising:

- a stationary volute and a moving volute describing an orbital movement, each volute including a plate from which extends a scroll, the scrolls of the stationary and moving volutes being engaged into each other and delimiting variable-volume compression chambers,
- a delivery line, made in the central portion of the plate of the stationary volute, comprising a first end opening into a central compression chamber and a second end intended to be put in communication with a delivery chamber made in the compressor,
- at least one delivery port arranged so as to put the delivery line and delivery chamber into communication,
- an anti-return device comprising:
  - a valve seat surrounding the delivery port, and
  - a delivery valve moveable between an obturation position in which the delivery valve bears against the valve seat and obturates the delivery port, and a release position in which the delivery valve is away from the valve seat and clears the delivery port, the delivery valve being designed so as to be displaced into its release position when the pressure in the delivery line exceeds the pressure in the delivery chamber by a first predetermined value,
- characterized in that it comprises:
- at least one bypass passage comprising a first end opening into the delivery line at a location located between the central compression chamber and the valve seat, and a second end opening into an intermediate compression chamber, and/or at least one bypass passage comprising a first end opening into the delivery line at a location located between the central compression chamber and the valve seat, and a second end opening into a low pressure portion of the compressor, and at least one bypass valve moveable between a position for obturating the bypass passage preventing the delivery line from being put into communication with the low pressure portion of the compressor or the intermediate compression chamber into which opens said bypass passage, and a position for clearing the bypass passage allowing the delivery line to be put into communication with the low pressure portion of the compressor or the intermediate compression chamber into which opens said bypass passage, the bypass valve being designed so as to be displaced into its release position when the pressure in the low pressure portion of the compressor or the intermediate compression chamber into which opens said bypass passage, exceeds the pressure in the delivery line by a second predetermined value.

The fact that each bypass passage opens into the delivery line upstream from the valve seat on which the delivery valve is intended to rest, allows limitation of the risks of leaks between the low pressure and high pressure portions of the compressor upon stopping the compressor, and therefore improvement in the performances of the latter.

Further, when the compressor comprises a bypass passage, one of the ends of which opens into the low pressure portion of the compressor, the latter is protected against any connection fault of the power supply wires of the electric motor.

Indeed, in the case of inversion of the direction of rotation of the driving shaft of the moving volute and of occurrence of a negative pressure at the center of the scrolls, the bypass valve elastically deforms towards its release position and puts the low pressure portion of the compressor in communication with the delivery line. These arrangements thereby avoid that the stationary and moving volutes be brought closer to one another, and therefore overheating and wear of the latter and prohibitive heating-up of the motor which may cause degradation of the compressor which might be detrimental to its performances.

Further, the fact that the bypass valve(s) is(are) located upstream from the delivery valve allows the use of a high pressure/low pressure separation plate, and simple and easy mounting of an arrangement of valves on the stationary volute of the compressor in spite of the presence of such a separation plate.

It should be noted that the first and second predetermined values substantially correspond to the adjustment pressures of the delivery valve and of the bypass valve, respectively.

Preferably, the compressor comprises at least one bypass passage, the first end of which opens into an internal circumferential wall of the delivery line.

Advantageously, the compressor comprises at least one bypass passage including a bypass chamber, a first bypass line comprising a first end opening into the corresponding intermediate compression chamber or the low pressure portion of the compressor and a second end opening into the bypass chamber, and a second bypass line comprising a first end opening into the bypass chamber and a second end opening into the delivery line.

According to an embodiment of the invention, the bypass valve is housed in the bypass chamber and is preferably arranged so as to obturate the second end of the first bypass line when it is in its obturation position.

According to an alternative embodiment of the invention, the compressor comprises an insert, mounted on the plate of the stationary volute, delimiting at least partly the bypass chamber.

Preferably, the first and second bypass lines are made in the plate of the stationary volute.

According to an embodiment of the invention, the compressor comprises at least one bypass passage comprising a bypass line including a first end opening into the corresponding intermediate compression chamber or the low pressure portion of the compressor and a second end opening into the delivery line.

Preferably, the bypass line is made in the plate of the stationary volute. Advantageously, the bypass valve is housed in the delivery line, and is preferably arranged so as to obturate the second end of the bypass line when it is found in its obturation position. Consequently, the mounting of the bypass valve is by no means hindered by the presence of a possible bell covering the stationary volute or of sealing elements at the delivery line.

Advantageously, the anti-return device includes a valve plate comprising said at least one delivery port, and on which is made the valve seat. According to an embodiment of the invention, the valve plate is mounted on the plate of the stationary volute at the second end of the delivery line.

According to an embodiment of the invention, the compressor comprises at least one bypass passage including a bypass recess, made in the surface of the valve plate turned towards the side of the plate of the stationary volute, opening into the delivery line and a bypass channel comprising a first end opening into the corresponding intermediate compression chamber or the low pressure portion of the compressor and a second end opening into the surface of the plate of the stationary volute turned towards the side of the valve plate of the anti-return device, facing the bypass recess.

Preferably, the bypass channel is made in the plate of the stationary volute. Each bypass recess is advantageously made in the valve plate at a location further away from the center of the valve plate than the delivery port. Preferably, the valve plate substantially has the shape of a disc, and each bypass recess is made in the valve plate radially outside the delivery port.

Advantageously, the compressor comprises at least one bypass valve made as an elastically deformable strip between a position for obturating the corresponding bypass passage and a position for clearing the corresponding bypass passage.

Advantageously, the compressor comprises a valve-holder plate positioned between the valve plate of the anti-return device and the plate of the stationary volute, the valve-holder plate comprising at least one bypass valve made with said valve-holder plate in the same material and made as an elastically deformable strip between a position for obturating the first end of the bypass channel and a position for clearing said first end.

Preferably, the compressor comprises abutment means arranged for limiting the range of movement of the delivery valve and/or of the bypass valve towards its release position.

The bottom of the bypass recess advantageously forms an abutment surface arranged so as to limit the movement range of the associated bypass valve towards its release position.

Advantageously, the compressor comprises a separation plate, mounted on the plate of the stationary volute so as to surround the delivery line, delimiting at least partly the delivery chamber. According to an embodiment of the invention, the valve plate is mounted on the separation plate.

According to another embodiment of the invention, the valve seat is made with the plate of the stationary volute in the same material and delimits the delivery port.

Anyway, the invention will be better understood by means of the description which follows with reference to the appended schematic drawing illustrating as non-limiting examples, several embodiments of this compressor.

In the following description, the same elements are designated with the same references in the different embodiments.

Figure 1:
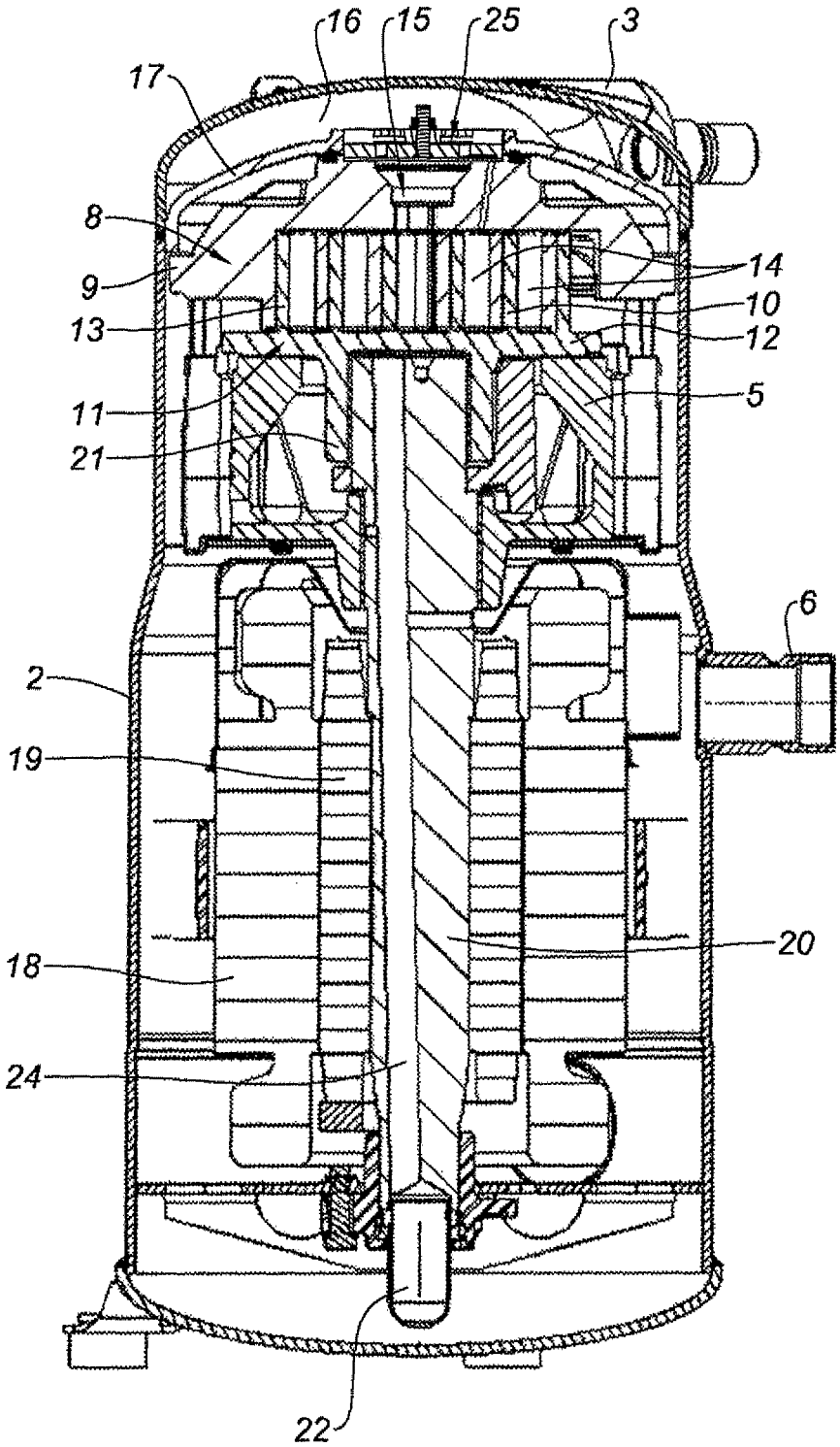
FIG. 1 is a longitudinal sectional view of a compressor according to a first embodiment of the invention.

FIG. 1 describes a scroll refrigeration compressor occupying a vertical position, however the compressor according to the invention may occupy a tilted position or a horizontal position, without its structure being modified significantly.

The compressor illustrated in FIG. 1 comprises a sealed enclosure delimited by a ferrule 2, the upper and lower ends of which are closed by a lid 3 and a base 4, respectively. The assembling of this enclosure may notably be achieved by means of welding beads.

The intermediate portion of the compressor is occupied by a body 5 which delimits two volumes, a suction volume located below the body 5, and a compression volume positioned above the latter. The ferrule 2 comprises a refrigerant gas inlet 6, opening into the suction volume in order to achieve supplying of gas to the compressor.

The body 5 is used for mounting a stage 7 for compressing the refrigerant gas. This compression stage 7 comprises a stationary volute 8 including a plate 9 from which extends a stationary scroll 10 turned downwards, and a moving volute 11 including a plate 12 bearing against the body 5 and from which extends a scroll 13 turned upwards. Both scrolls 10 and 13 of both volutes penetrate into each other in order to make variable-volume compression chambers 14.

The compressor further comprises a delivery line 15 made in the central portion of the stationary volute 8. The delivery line 15 comprises a first end opening into the central compression chamber 14*a* and a second end intended to be put into communication with a high pressure delivery chamber 16 made in the enclosure of the compressor. The delivery chamber 16 is partly delimited by a separation plate 17 mounted on the plate 9 of the stationary volute 8 so as to surround the delivery line 15.

The compressor comprises a three-phase electric motor positioned in the suction volume. The electric motor comprises a stator 18, at the center of which is positioned a rotor 19.

The rotor 19 is firmly attached to a driving shaft 20, the upper end of which is off-axis like a crankshaft. This upper portion is engaged into a sleeve-shaped portion 21, which the moving volute 11 includes. During its driving into rotation by the motor, the driving shaft 20 drives the moving volute 11 along an orbital movement.

The lower end of the driving shaft 20 drives an oil pump 22 feeding oil contained in a case 23 delimited by the base 4, to an oil supply line 24 made in the central portion of the driving shaft, the supply line 24 being off-axis and extending over the whole length of the driving shaft 20.

Figure 2:
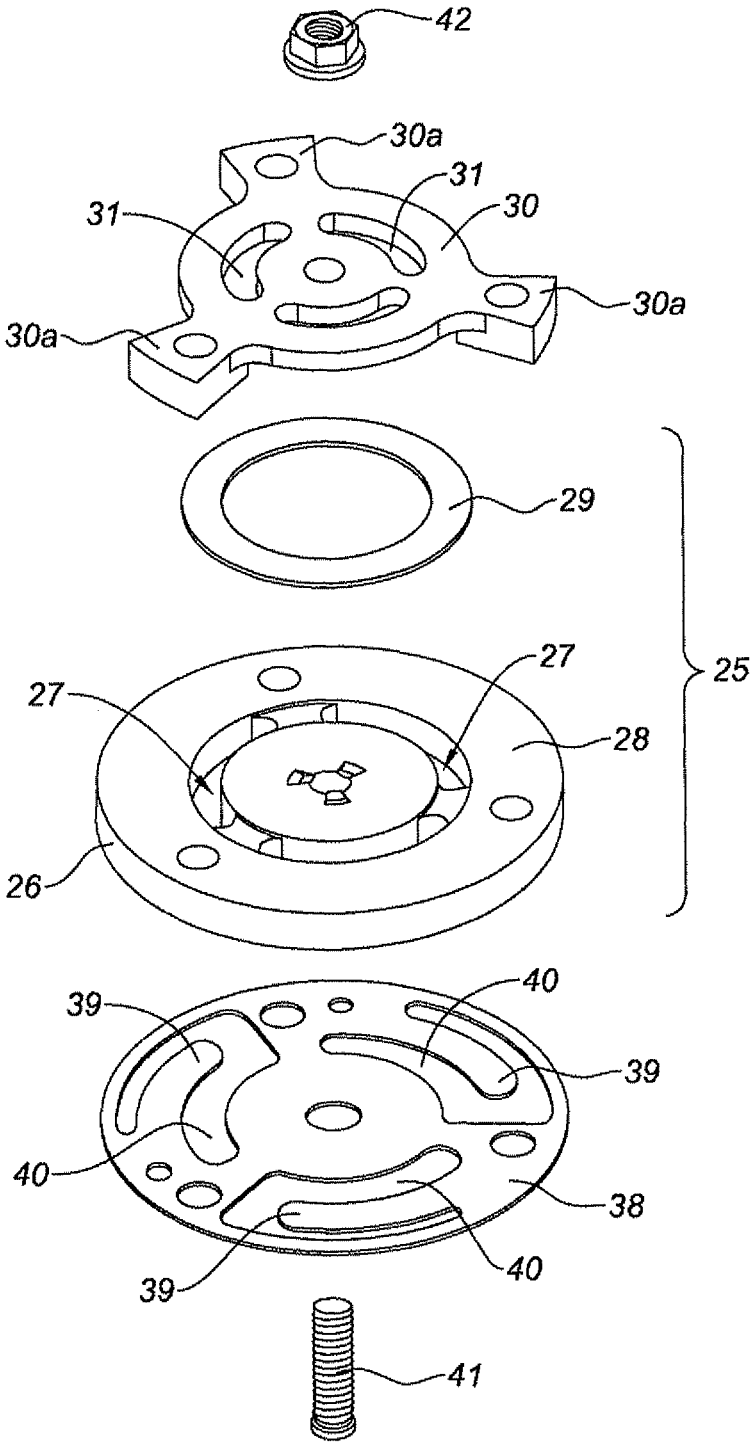
FIG. 2 is an exploded view in a top perspective, of a valve arrangement of the compressor of FIG. 1.
Figure 3:
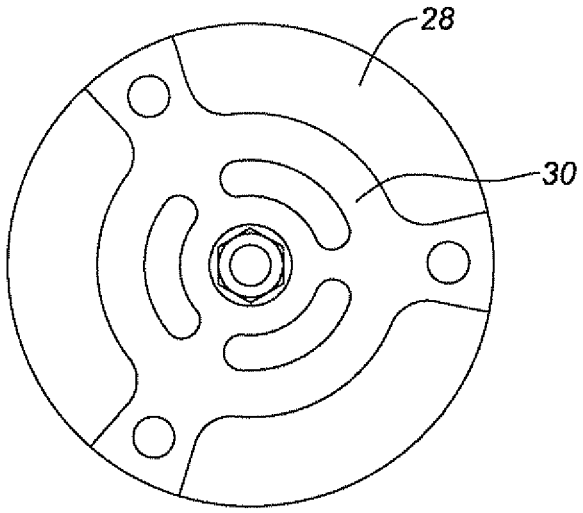
FIG. 3 is a top view of the valve arrangement of FIG. 2.
Figure 4:
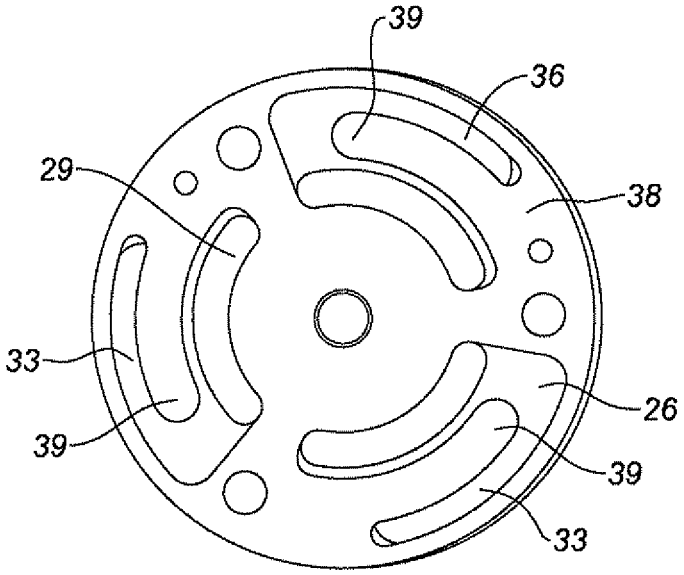
FIG. 4 is a bottom view of the valve arrangement of FIG. 2.
Figure 6:
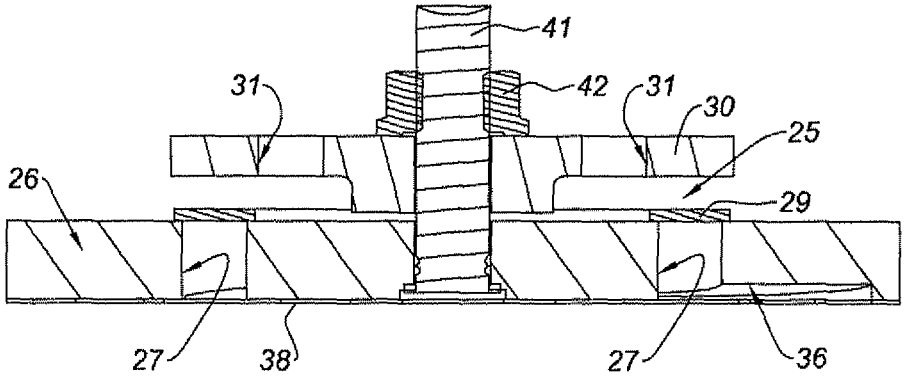
FIG. 6 is a sectional view of the valve arrangement of FIG. 2.
Figure 7:
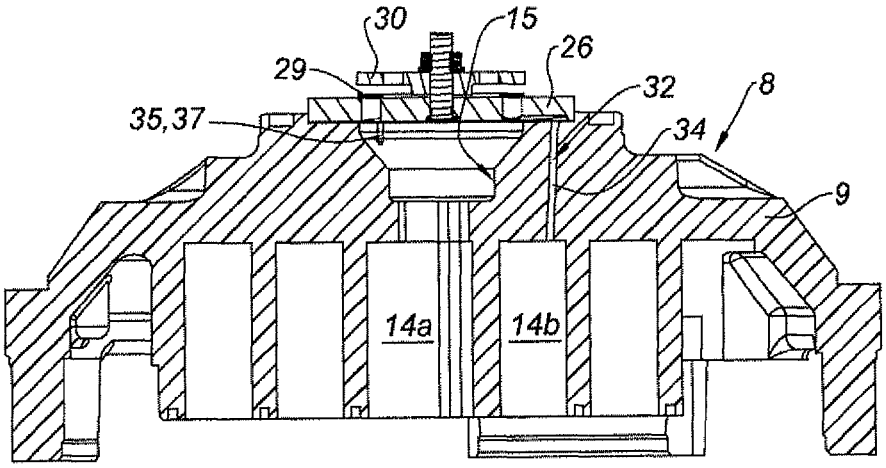
FIG. 7 is a sectional view of the stationary volute of the compressor of FIG. 1 equipped with the valve arrangement of FIG. 2.

As shown more particularly in FIGS. 2 and 6, the compressor comprises an anti-return device 25. The anti-return device 25 includes a disc-shaped valve plate 26 mounted on the plate 9 of the stationary volute 8 at the second end of the delivery line 15. The valve plate 26 comprises a plurality of delivery ports 27 arranged in order to put the delivery line 15 and the delivery chamber 16 in communication, and a valve seat 28 made on the surface of the valve plate 26 opposite to the stationary volute 8 and surrounding the delivery ports 27. The delivery ports 27 have the shape of a bean but may have any other shape for example a cylindrical shape.

The anti-return device 25 also includes a delivery valve 29 moveable between an obturation position in which the delivery valve 29 bears against the valve seat 28 and obturates the delivery ports 27, and a release position in which the delivery valve 29 is away from the valve seat 28 and clears the delivery ports 27. The delivery valve 29 is designed so as to be displaced into its release position when the pressure in the delivery line 15 exceeds the pressure in the delivery chamber 16 by a first predetermined value substantially corresponding to the adjustment pressure of the delivery valve 29. The delivery valve 29 is for example substantially ring-shaped.

The compressor also comprises a retaining plate 30 mounted on the valve plate 26 and intended to be used as an abutment for the delivery valve 29 when it is in its release position. The retaining plate 30 comprises three supporting portions 30*a* intended to rest on the valve plate 26 and at least one passage orifice 31 arranged so as to allow refrigerant fluid flow from the delivery ports 27 towards the delivery chamber 16. The retaining plate 30 may comprise one or several orifice passages 31, and each passage orifice 31 may have for example the shape of a bean or a cylindrical shape.

Figure 5:
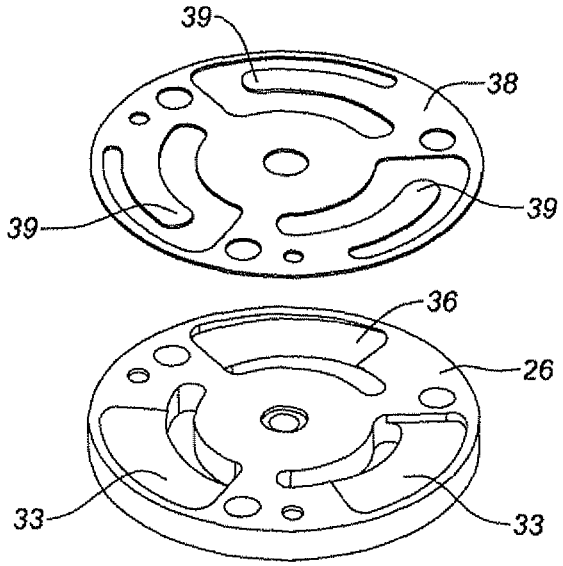
FIG. 5 is an exploded partial view in a perspective from below, of the valve arrangement of FIG. 2.

The compressor further comprises two bypass passages 32 (only one bypass passage 32 is visible in the figures). Each bypass passage 32 is formed with a bypass recess 33 (shown more particularly in FIG. 5) made in the surface of the valve plate 26 turned towards the side of the plate 9 of the stationary volute 8, and opening into the delivery line 15 on the one hand and through a bypass channel 34 made in the plate 9 of the stationary volute and comprising a first end opening into an intermediate compression chamber 14*b* and a second end opening into the surface of the plate 9 of the stationary volute 8 turned on the side of the valve plate 26, facing the corresponding bypass recess 33, on the other hand.

The compressor further comprises a bypass passage 35 formed by a bypass recess 36 made in the surface of the valve plate 26 turned towards the side of the plate 9 of the stationary volute 8, and opening into the delivery line 15 on the one hand, and through a bypass channel 37 made in the plate 9 of the stationary volute and comprising a first end opening into a low pressure portion of the compressor and a second end opening into the surface of the plate 9 of the stationary volute 8 turned towards the side of the valve plate 26, facing the bypass recess 36 on the other hand.

Preferably, the bypass recesses 33, 36 are identical and are respectively made in the valve plate 26 at a location further away from the center of the latter than the delivery ports 27.

The compressor further comprises a valve-holder plate 38 positioned between the valve plate 26 of the anti-return device 25 and the plate 9 of the stationary volute 8. The valve-holder plate 38 substantially has a disc shape.

The valve-holder plate 38 comprises three bypass valves 39 made with said valve-holder plate in the same material and each made as an elastically deformable strip between a position for obturating the first end of the corresponding bypass channel and a position for clearing said first end. The bypass valves 39 are preferably regularly distributed around the center of the valve-holder plate 38 and extend for example substantially as a circular arc.

Each bypass valve 39 is designed so as to be displaced into its release position when the pressure in the low pressure portion of the compressor or the intermediate compression chamber 14*b* into which opens the corresponding bypass passage, exceeds the pressure in the delivery line 15 by a second predetermined value, substantially corresponding to the adjustment pressure of said bypass valve 39.

It should be noted that the bottom of each bypass recess 33, 36 made in the valve plate 26 advantageously forms an abutment surface arranged so as to limit the movement range of the associated bypass valve 39 towards its release position.

The valve-holder plate 38 further comprises at least one passage orifice 40 arranged for allowing refrigerant fluid flow from the delivery line 15 to the delivery ports 27. The valve-holder plate 38 may comprise one or several passage orifices 40 and each passage orifice 40 may for example have a bean shape or cylindrical shape.

Advantageously, the valve-holder plate 38, the valve plate 26 and the retaining plate 30 are secured to each other via a screw 41 crossing orifices made in the central portions of the latter and of a nut 42. Thus, these three plates and the delivery valve 29 form a compact valve arrangement which may easily be mounted on the plate 9 of the stationary volute 8. This valve arrangement may be mounted on the plate of the stationary volute 8 for example by means of three fixing screws crossing orifices made in the three plates and screwed into tapped holes made in the plate 9 of the stationary volute 8.

The operation of the scroll compressor will now be described.

When the scroll compressor according to the invention is started, the moving volute 11 is driven by the driving shaft 20 along an orbital movement, this movement of the moving volute causing admission and compression of refrigerant fluid in the variable-volume compression chambers 14.

Under optimum operating conditions, each bypass valve 39 intended to obturate a bypass passage 32 opening into one of the compression chambers 14 is subject, on its face turned towards the plate 9 of the stationary volute 8, to a pressure below the pressure in the delivery line 15. Thus, said bypass valve 39 are maintained in their obturation position and therefore isolate the compression chambers 14 into which open the corresponding bypass passages 32.

Consequently, the totality of the compressed refrigerant fluid in the compression chambers 14 reaches as far as the center of the scrolls and escapes through the delivery line 15 towards the delivery chamber 16 by flowing through the passage orifices 40 and the delivery ports 27, and then by displacing the delivery valve 29 into its release position, and finally by axially flowing through the passage orifices 31 and radially through the spaces delimited between the attachment portions 30*a*.

Accordingly, under optimum operating conditions, the <<design>> compression rate of the compressor corresponds to the compression rate imposed by the operating conditions, and consequently the <<actual>> compression rate of the compressor is maintained at its maximum value.

Under operating conditions imposing a lower compression rate than the <<design>> compression rate of the compressor, each bypass valve 39 intended to obturate a bypass passage 32 opening into one of the compression chambers 14 may be subject, on its face turned towards the plate 9 of the stationary volute 8, to a pressure above the pressure in the delivery line 15. In this scenario, said bypass valves 39 elastically deform towards their release position and put the compression chambers 14 in communication, into which open the corresponding bypass passages 32 with the delivery line 15 made in the stationary volute 8. The result of this is delivery towards the delivery line 15 of a portion of the compressed refrigerant fluid in the compression chambers 14 into which open the bypass channels 33 before this portion of refrigerant fluid reaches as far as the center of the scrolls.

With these arrangements, it is possible to reduce the compression rate of each compression chamber, and therefore of the compressor. Overcompression of the refrigerant fluid is consequently avoided, which gives the possibility of improving the energy efficiency of the compressor and of limiting the wear of the latter.

In the case of a connection fault in the power supply wires of the electric motor causing an inversion of the direction of rotation of the driving shaft 20 of the moving volute and generation of a negative pressure at the center of the scrolls 10, 13, the bypass valve 39 intended to obturate the bypass passage 35 opening into the low pressure portion of the compressor is subject, on its face turned towards the plate 9 of the stationary volute 8, to a pressure above the pressure in the delivery line 15. Thus, said bypass valve 39 elastically deforms towards its release position and puts the low pressure portion of the compressor into communication with the delivery line 15. These arrangements avoid that the stationary and moving volutes be brought closer to each other, and therefore overheating of the latter which may cause degradation of the compressor if the connection fault is not detected sufficiently early.

Figure 8:
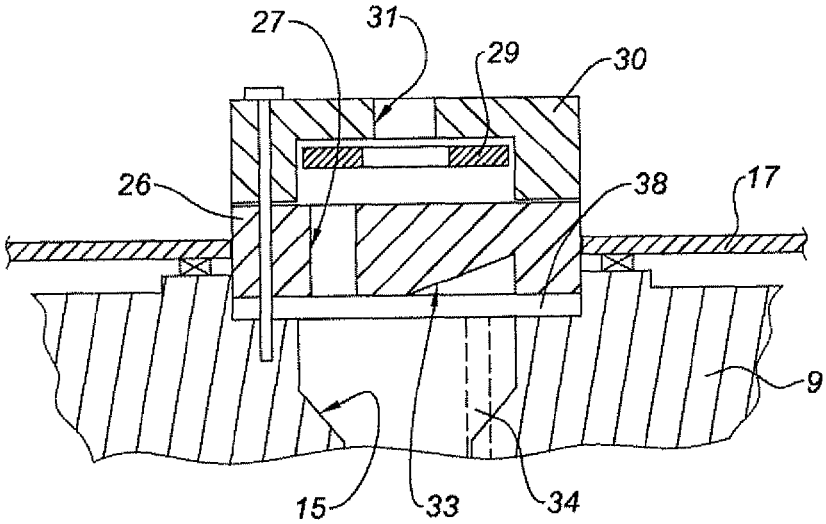
FIG. 8 is a partial sectional view of a compressor according to a second embodiment of the invention.
Figure 9:
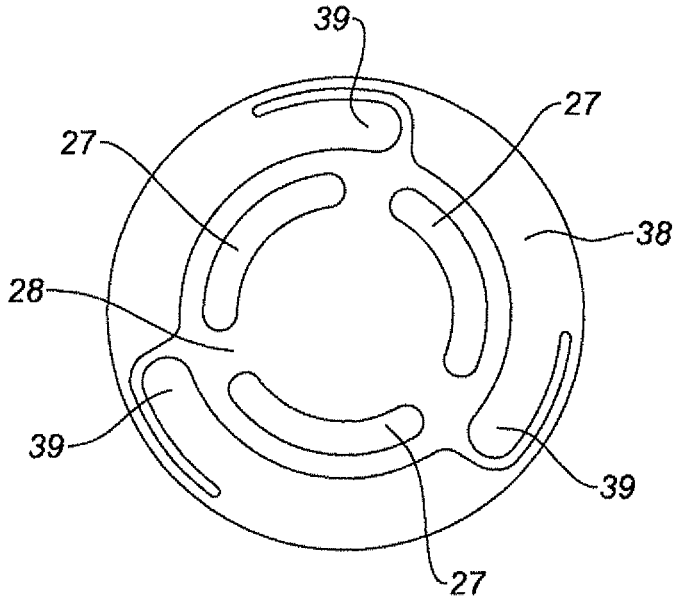
FIG. 9 is a bottom view of the valve arrangement of the compressor of FIG. 8.

FIGS. 8 and 9 represent a second embodiment of the invention which differs from the one illustrated in FIGS. 1 to 7 in that the valve-holder plate 38 is substantially ring-shaped, and in that the retaining plate 30 only includes a single passage orifice 31.

Figure 10:
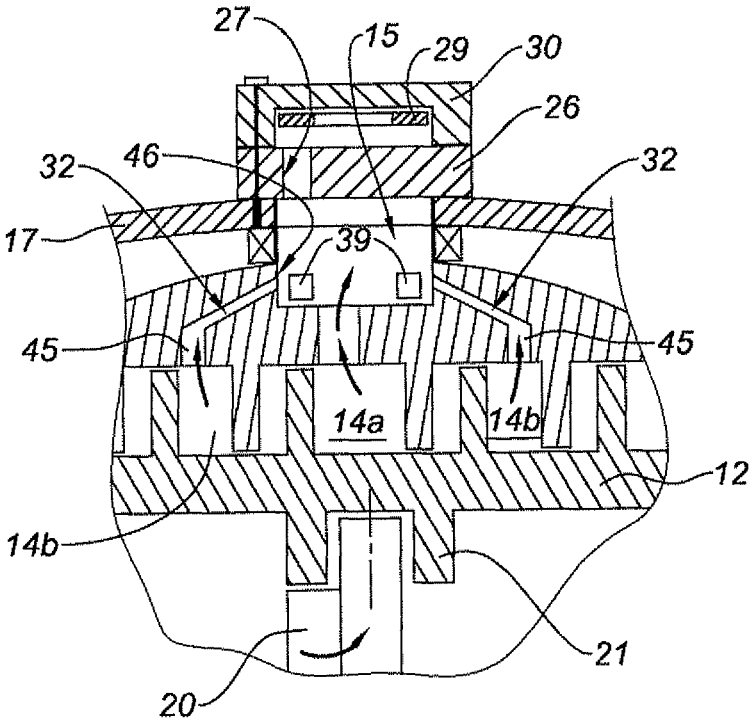
FIG. 10 is a partial sectional view of a compressor according to a third embodiment of the invention.

FIG. 10 illustrates a third embodiment of the invention which differs from the one illustrated in FIGS. 1 to 7 essentially in that the compressor comprises two bypass passages 32 each comprising a bypass line 45 made in the plate 9 of the stationary volute 8 and including a first end opening into an intermediate compression chamber 14*b* and a second end opening into the internal circumferential wall 46 of the delivery line 15, and in that the valve plate 26 is mounted on the separation plate 17.

According to this embodiment, the compressor comprises two bypass valves 39 housed in the delivery line 15 and each made in the shape of an elastically deformable strip between a position for obturating the second end of the corresponding bypass line 45 and a position for clearing the second end of the corresponding bypass line 45.

Each bypass valve 39 may for example be attached by screwing onto the internal circumferential wall 46 of the delivery line 15.

Figure 11:
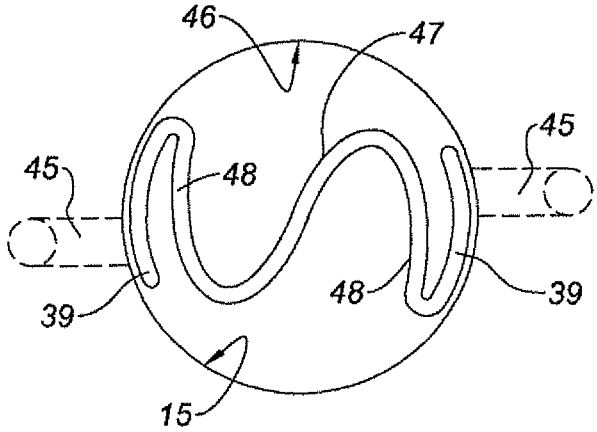
FIG. 11 is a partial top view of a first alternative embodiment of the compressor of FIG. 10.

According to an alternative embodiment illustrated in FIG. 11, the compressor further comprises a substantially S-shaped holding member 47, the ends of which are arranged so as to each cooperate with one of the bypass valves 39 so as to maintain the latter in position. Thus, according to this alternative embodiment, it is not necessary to attach the bypass valve 39 onto the plate 9 of the stationary volute 8, which simplifies the mounting of the compressor.

Each portion 48 of the holding member 47 located along one of the bypass valves 39 forms an abutment surface limiting the movement ranges of the associated bypass valve.

Preferably, the holding member 47 is designed in order to flatten the bypass valves 39 against the internal wall 46 of the delivery line 15.

Advantageously, the ends of the holding member 47 are firmly secured to the bypass valves 39, for example by welding. These arrangements further facilitate the mounting of the bypass valves.

Figure 12:
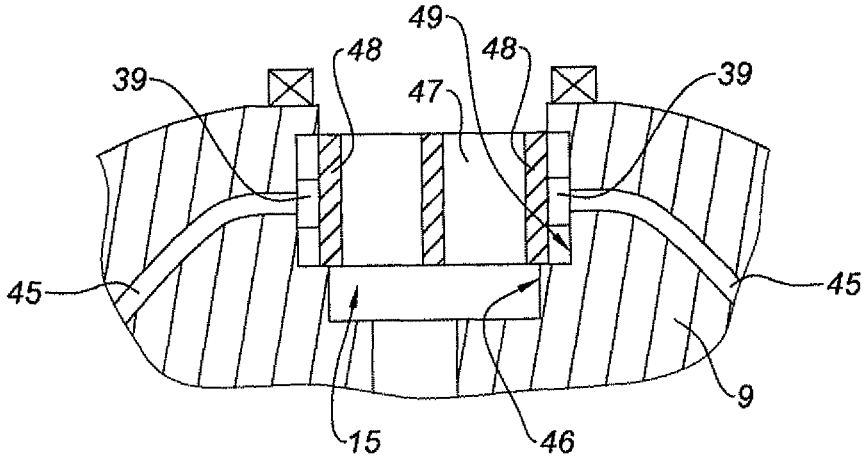
FIG. 12 is a partial sectional view of a second alternative embodiment of the compressor of FIG. 10.

According to an alternative embodiment illustrated in FIG. 12, the delivery line 15 comprises an annular groove 49 in which are positioned the bypass valves 39. The annular groove 49 may however be replaced with two localized grooves in which the bypass valves will be respectively positioned.

Figure 13:
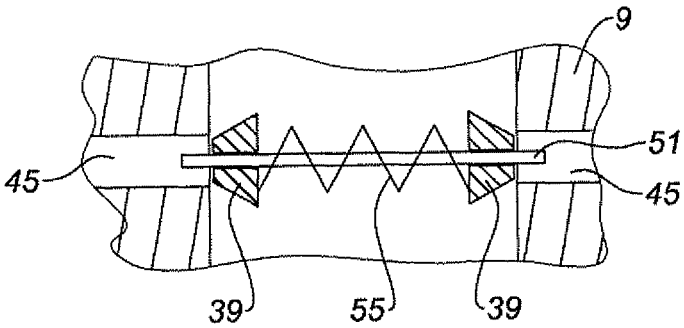
FIG. 13 is a partial sectional view of a third alternative embodiment of the compressor of FIG. 10.

According to another alternative embodiment illustrated in FIG. 13, both bypass valves 39 are slideably mounted on a rod 51 inserted into the ends of the bypass lines 45 opening into the delivery line 15, and the rod 54 comprises elastic means, such as a coil spring 55, interposed between both bypass valves 39 and designed for urging each bypass valve towards its obturation position.

Figure 14:
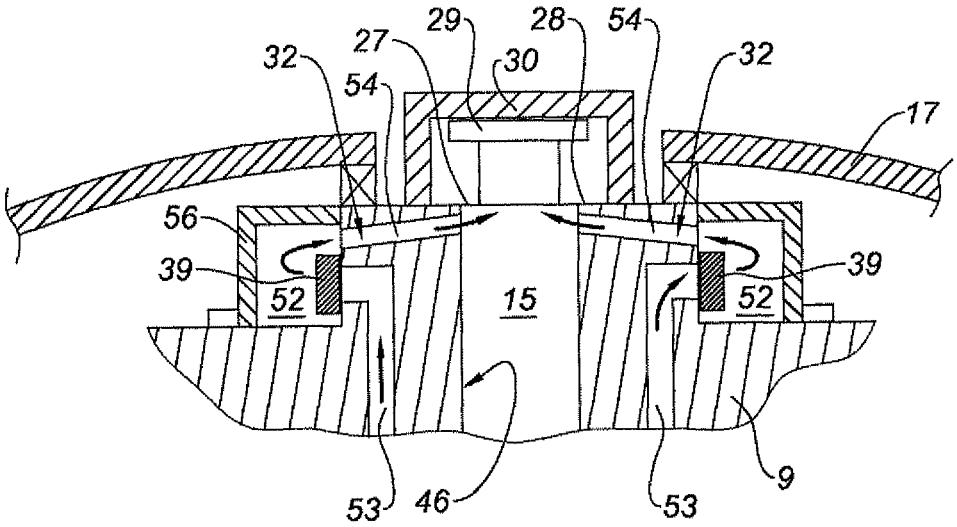
FIG. 14 is a partial sectional view of a compressor according to a fourth embodiment of the invention.
Figure 15:
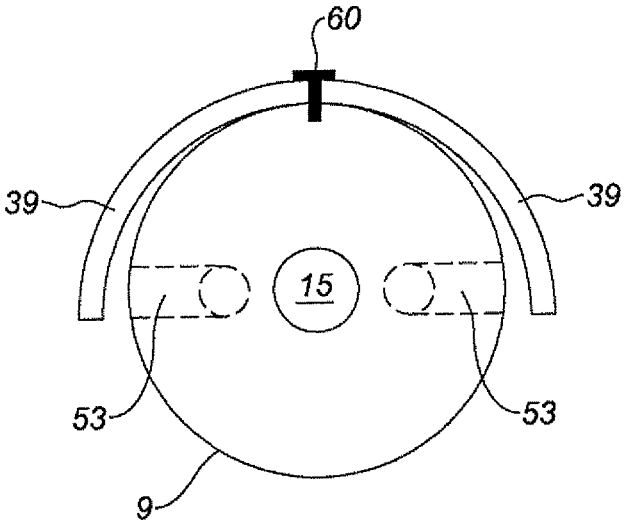
FIG. 15 is a partial sectional view of the compressor of FIG. 14.

FIGS. 14 and 15 illustrate a fourth embodiment of the invention which differs from the one illustrated in FIGS. 1 to 7, essentially in that the valve seat 28 is made with the plate 9 of the stationary volute 8 in the same material and delimits a delivery port 27 and in that the compressor comprises two bypass passages 32 each including a bypass chamber 52, a first bypass line 53, made in the plate 9 of the stationary volute 8, comprising a first end opening into the corresponding intermediate compression chamber 14*b* and a second end opening into the bypass chamber 52, and a second bypass line 54 made in the plate of the stationary volute, comprising a first end opening into the bypass chamber 52 and a second end opening into the internal circumferential wall 46 of the delivery line 15, upstream from the valve seat 28. It should be noted that the bypass chambers 52 of both bypass passages coincide as this is illustrated in FIG. 14, but may for example be distinct from each other.

According to this embodiment, the compressor includes an insert 56 mounted on the plate 9 of the stationary volute between the latter and the separation plate 17, the insert 56 partly delimiting the bypass chamber 52 on the one hand and two bypass valves 39 housed in the bypass chamber 52 and each made as an elastically deformable strip between a position for obturating the second end of the corresponding first bypass line 53 and a position for clearing the second end of the corresponding first bypass line 53 on the other hand.

Preferably, both bypass valves 39 are firmly attached to each other and are attached on the plate 9 of the stationary volute with a fixing screw 60.

According to an alternative embodiment, at least one of the bypass lines 53 may be opened into a low pressure portion of the compressor, or the compressor may further comprise a bypass passage connected to the low pressure portion of the compressor.

As this is obvious, the invention is not limited to the sole embodiments of this scroll refrigeration compressor, described as examples, on the contrary, it encompasses all the alternative embodiments.

The invention claimed is:

1. A scroll refrigeration compressor comprising:

a stationary volute and a moving volute having an orbital movement, the stationary volute and the moving volute each including a plate from which extends a scroll, the scrolls of the stationary and moving volutes being engaged with each other and delimiting a plurality of variable-volume compression chambers, a delivery chamber, a delivery line in a central portion of the plate of the stationary volute including a first end that opens into a central compression chamber and a second end configured to communicate with the delivery chamber, an anti-return device including:

a valve plate including at least one delivery port configured to communicate between the delivery line and the delivery chamber, a valve seat on the valve plate, the valve seat surrounding the delivery port, and a delivery valve moveable between an obturation position in which the delivery valve bears against the valve seat and obturates the delivery port, and a release position in which the delivery valve is away from the valve seat and clears the delivery port, the delivery valve being configured to be displaced into the release position when the pressure in the delivery line exceeds the pressure in the delivery chamber by a first predetermined value, a first bypass passage including a first end that opens into the delivery line at a location located between the central compression chamber and the valve seat, and a second end that opens into an intermediate compression chamber, the first bypass passage including:

a bypass recess in a surface of the valve plate of the anti-return device turned towards the side of the plate of the stationary volute, the bypass recess opening into the delivery line, and a bypass channel facing the bypass recess, the bypass channel including a first channel end that opens into the corresponding intermediate compression chamber, and a second channel end that opens into a surface of the plate of the stationary volute turned towards the side of the valve plate of the anti-return device, the second channel end of the bypass channel facing the bypass recess of the first bypass passage, and a first bypass valve moveable between an obturation position in which the first bypass valve obturates the first bypass passage to prevent the delivery line from communicating with the intermediate compression chamber into which opens the bypass passage, and a release position in which the first bypass valve clears the first bypass passage so that the delivery line communicates with the intermediate compression chamber into which opens the first bypass passage, the first bypass valve being configured to be displaced into the release position when the pressure in the intermediate compression chamber into which opens the first bypass passage exceeds the pressure in the delivery line by a second predetermined value.

2. The scroll refrigeration compressor according to claim 1, further comprising:

a second bypass passage including a first end that opens into the delivery line at a location located between the central compression chamber and the valve seat, and a second end that opens into a suction pressure portion of the scroll refrigeration compressor, and a second bypass valve configured to move between an obturation position in which the second bypass valve obturates the second bypass passage to prevent the delivery line from communicating with the suction pressure portion of the scroll refrigeration compressor, and a release position in which the second bypass valve clears the second bypass passage so that the delivery line communicates with the suction pressure portion of the scroll refrigeration compressor, the second bypass valve being configured to be displaced into the release position when the pressure in the suction pressure portion of the scroll refrigeration compressor exceeds the pressure in the delivery line by the second predetermined value.

3. The scroll refrigeration compressor according to claim 2, wherein the second bypass passage includes:

a bypass recess in the surface of the valve plate of the anti-return device turned towards the side of the plate of the stationary volute, the bypass recess opening into the delivery line, and a bypass channel including a first channel end that opens into the suction pressure portion and a second channel end that opens into the surface of the plate of the stationary volute turned towards the side of the valve plate of the anti-return device, the second channel end facing the bypass recess of the second bypass passage.

4. The scroll refrigeration compressor according to claim 3, further comprising:

a valve-holder plate positioned between the valve plate of the anti-return device and the plate of the stationary volute, the valve-holder plate including the second bypass valve made with the valve-holder plate in the same material and formed as a strip configured to elastically deform between: (i) an obturation position in which the strip obturates the first channel end of the bypass channel of the second bypass passage, and (ii) a release position in which the strip clears the first channel end of the bypass channel of the second bypass passage.

5. The scroll refrigeration compressor according to claim 3, wherein a bottom of the bypass recess of the second bypass passage forms an abutment surface configured to limit the movement range of the second bypass valve towards the release position.

6. The scroll refrigeration compressor according to claim 1, wherein the first bypass passage includes a bypass line that includes:

a first end that opens into the corresponding intermediate compression chamber, and a second end that opens into the delivery line.

7. The scroll refrigeration compressor according to claim 1, wherein the first bypass valve is formed as a strip that is elastically deformable between an obturation position in which the strip obturates the first bypass passage, and a release position in which the strip clears the first bypass passage.

8. The scroll refrigeration compressor according to claim 1, further comprising:

a valve-holder plate positioned between the valve plate of the anti-return device and the plate of the stationary volute, the valve-holder plate including the first bypass valve made with the valve-holder plate in the same material and formed as a strip configured to elastically deform between: (i) an obturation position in which the strip obturates the first channel end of the bypass channel and (ii) a release position in which the strip obturates the first channel end of the bypass channel.

9. The scroll refrigeration compressor according to claim 8, wherein a bottom of the bypass recess forms an abutment surface configured to limit the movement range of the first bypass valve towards the release position.

10. The scroll refrigeration compressor according to claim 1, further comprising an abutment member configured to limit the movement range of the delivery valve and/or of the first bypass valve towards the release position.

11. The scroll refrigeration compressor according to claim 1, further comprising a separation plate mounted on the plate of the stationary volute so as to surround the delivery line, the separation plate at least partially delimiting the delivery chamber.

* * * * *